US008813762B1

(12) United States Patent
Shooshan

(10) Patent No.: US 8,813,762 B1
(45) Date of Patent: Aug. 26, 2014

(54) HAIR STYLING DEVICE

(71) Applicant: Hai Shooshan, Bnei Brak (IL)

(72) Inventor: Hai Shooshan, Bnei Brak (IL)

( * ) Notice: Subject to any disclaimer, the term of this patent is extended or adjusted under 35 U.S.C. 154(b) by 0 days.

(21) Appl. No.: 13/849,506

(22) Filed: Mar. 24, 2013

(51) Int. Cl.
*A45D 24/00* (2006.01)

(52) U.S. Cl.
CPC ..... *A45D 24/00* (2013.01)
USPC ..... 132/219

(58) Field of Classification Search
USPC ..... 132/200, 120, 219, 140, 156, 158, 160
See application file for complete search history.

(56) References Cited

U.S. PATENT DOCUMENTS

| | | | | |
|---|---|---|---|---|
| 88,811 A | | 4/1869 | Robertson | |
| 2,678,048 A | * | 5/1954 | Poetto | 132/156 |
| 3,835,870 A | * | 9/1974 | Sick | 132/160 |
| 4,325,393 A | | 4/1982 | Thomas | |
| 4,993,438 A | | 2/1991 | Hunt | |
| 5,458,108 A | * | 10/1995 | Jacobs | 132/156 |
| 5,575,297 A | | 11/1996 | Hatchett et al. | |
| 5,937,868 A | | 8/1999 | Ogunro | |
| 6,050,272 A | | 4/2000 | Droin | |
| 7,231,925 B1 | * | 6/2007 | Wall | 132/149 |
| 8,347,895 B2 | | 1/2013 | Campbell Rose | |
| 2012/0037176 A1 | | 2/2012 | Ito | |

FOREIGN PATENT DOCUMENTS

| | | |
|---|---|---|
| CN | 2168451 Y | 6/1994 |
| CN | 2805473 Y | 8/2006 |
| DE | 806990 C | 3/1952 |
| GB | 2350293 A | 11/2000 |

OTHER PUBLICATIONS

Ribbon Bow Hair Comb, http://www.aliexpress.com/item/Wholesale-12pics-lot-Free-Shipping-Fashion-Ribbon-Bow-Hair-comb-Woman-Hair-styling-Hair-Accessories/496876313.html.

* cited by examiner

*Primary Examiner* — Rachel Steitz

(57) ABSTRACT

A hair styling device comprising a substantially flat body having two opposite edges, a first longer edge and a second shorter edge opposite the first edge, slanting recesses separating the shorter edge into a plurality of tooth-bases, the slanting recesses defining a plurality of evenly spaced substantially triangular teeth.

1 Claim, 4 Drawing Sheets

HAIR STYLING DEVICE

TECHNOLOGY FIELD

The present invention pertains to a hairstyling device for separating hair into strands.

BACKGROUND

Various devices for separating hair into strands are known in the art.

U.S. Pat. No. 4,325,393 to Louis N. Thomas provides a hair styling implement to facilitate the withdrawal of spaced groups of hair strands from the scalp for separate treatment with bleach or the like for "frosting" or "streaking" has a plurality of equi-distantly spaced, arcuate hook members movable between open and closed positions with respect to the bottom surface of the body of the implement by an operating slide member at its top. After thus hookingly engaging spaced groups of hair strands for treatment, the implement is lifted from the scalp to isolate the strand groups thus selected for bleach or dye treatment.

U.S. Pat. No. 4,993,438 to Hunt Marjorie A. provides a hair weaving comb for rapidly and evenly separating hair for highlighting and the like includes a set of legs extending from an elongate support member. Distal end portions of the legs include hair separating teeth for separating a section of hair into sub-sections. When the legs of the comb are initially inserted into a section of hair, the teeth create sub-sections of hair. When the legs are further inserted in the section of hair, the teeth group and displace alternate hair sub-sections away from other alternate hair sub-sections. The other alternate hair sub-sections are bypassed by the teeth and slide into hair-receiving slots formed between the spaced-apart legs of the hair weaving comb. When the legs are still further inserted through the hair section, the displaced hair sub-sections are pushed out of a hairstylists's hand and readily fall out of the teeth of the distal end of the comb and down to the head of the customer. The hair weaving comb creates a number of thin hair sub-sections simultaneously from a wide hair section and hence provides an instantaneous separation of a section of hair. Furthermore, the hair weaving comb creates sub-sections of an equal width to provide an even coloring for highlighting of the hair.

U.S. Pat. No. 5,575,297 to Hatchett Jerry provides a generally hand-shaped hair styling device for independently retaining a plurality of separate sections of hair, comprising a rigid frame assembly comprising a curved rigid base with a plurality of adjacent elongated rigid members joined to and arising in a perpendicular manner from the curved rigid base in such a manner that slots are formed between the adjacent elongated members, each of the slots being of sufficient height and width to accommodate and retain a section of hair containing multiple strands of hair, the section consisting of a sufficient number of strands of hair as to be suitable for braiding, wherein the slots contain adjacent resilient surfaces in close proximity to each other, thereby enhancing the ability of the device to retain the sections of the hair.

U.S. Pat. No. 5,937,868 to Ogunro E. Olayinka provides an apparatus to separate hair into units of three for braiding, producing several such units in one application. The preferred embodiment comprises a platform having an upper shelf and an anchor. The anchor has comb-like teeth for fixing the device to the hair of the subject. The upper shelf prevents tangling of unbraided hair above the device. A blade, fixed perpendicularly to the platform, has a plurality of teeth separated by notches of alternating depths, which receive strands of hair. A lower shelf affixed at an angle acts as a support for the separated hair strands and prevents tangling. The upper and lower shelves are made removable. The width between braids may be varied by providing teeth of different widths on the upper shelf.

All the above patents and others provide for separating hair into alternate strands, for example for bleaching purposes where alternate hair strands are bleached.

SUMMARY

According to a first aspect of the present invention there is provided a hair styling device comprising a substantially flat body having two opposite edges, a first longer edge and a second shorter edge opposite the first edge, slanting recesses separating said shorter edge into a plurality of tooth-bases, said slanting recesses defining a plurality of evenly spaced substantially triangular teeth.

According to a first aspect of the present invention there is provided a hair styling method comprising: providing a hair styling device comprising a substantially flat body having two opposite edges, a first longer edge and a second shorter edge opposite the first edge, slanting recesses separating said shorter edge into a plurality of tooth-bases, said slanting recesses defining a plurality of evenly spaced substantially triangular teeth; inserting the teeth into a hair strand, wherein the hair strand is divided into a plurality of even spaced-apart sub-strands held between the teeth; firming the sub-strands; and manipulating the hair styling device to shape the firmed sub-strands into a desired shape.

BRIEF DESCRIPTION OF THE DRAWINGS

For better understanding of the invention and to show how the same may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF THE PRESENT INVENTION

The present invention provides a hair styling device for separating a hair strand into a plurality of sub-strands. Unlike separation by prior-art devices, where alternate sub-strands are created on different levels and are used to perform operations such as bleaching thereon, the sub-strands created by using the device according to the present invention are parallel, i.e. created on a single level, and are used to create elaborate hair styles comprising "fanning" effects, previously requiring accurate manual hair strand separation.

Figure 2:
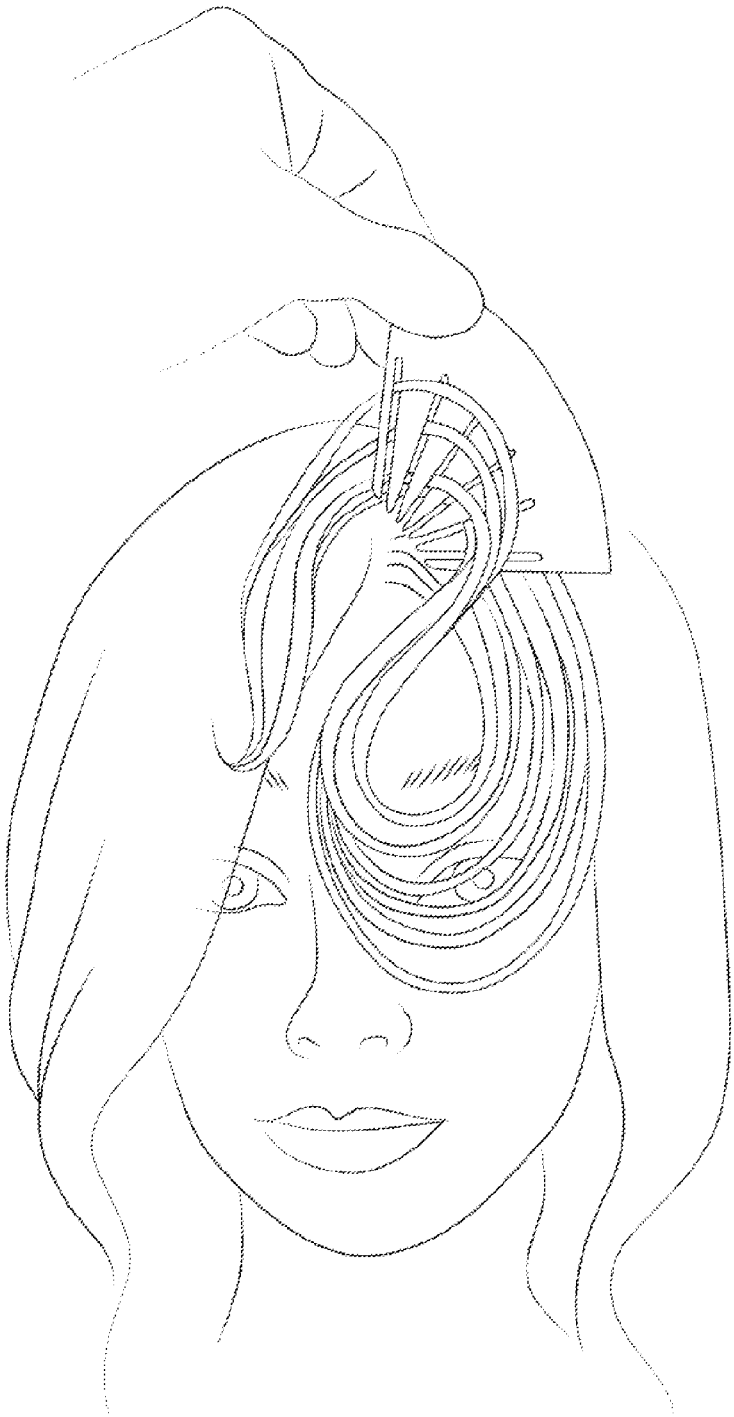
FIG. 2 shows an exemplary fanned-out hair strand.

FIG. 2 shows an exemplary fanned-out hair strand.

Figure 3:
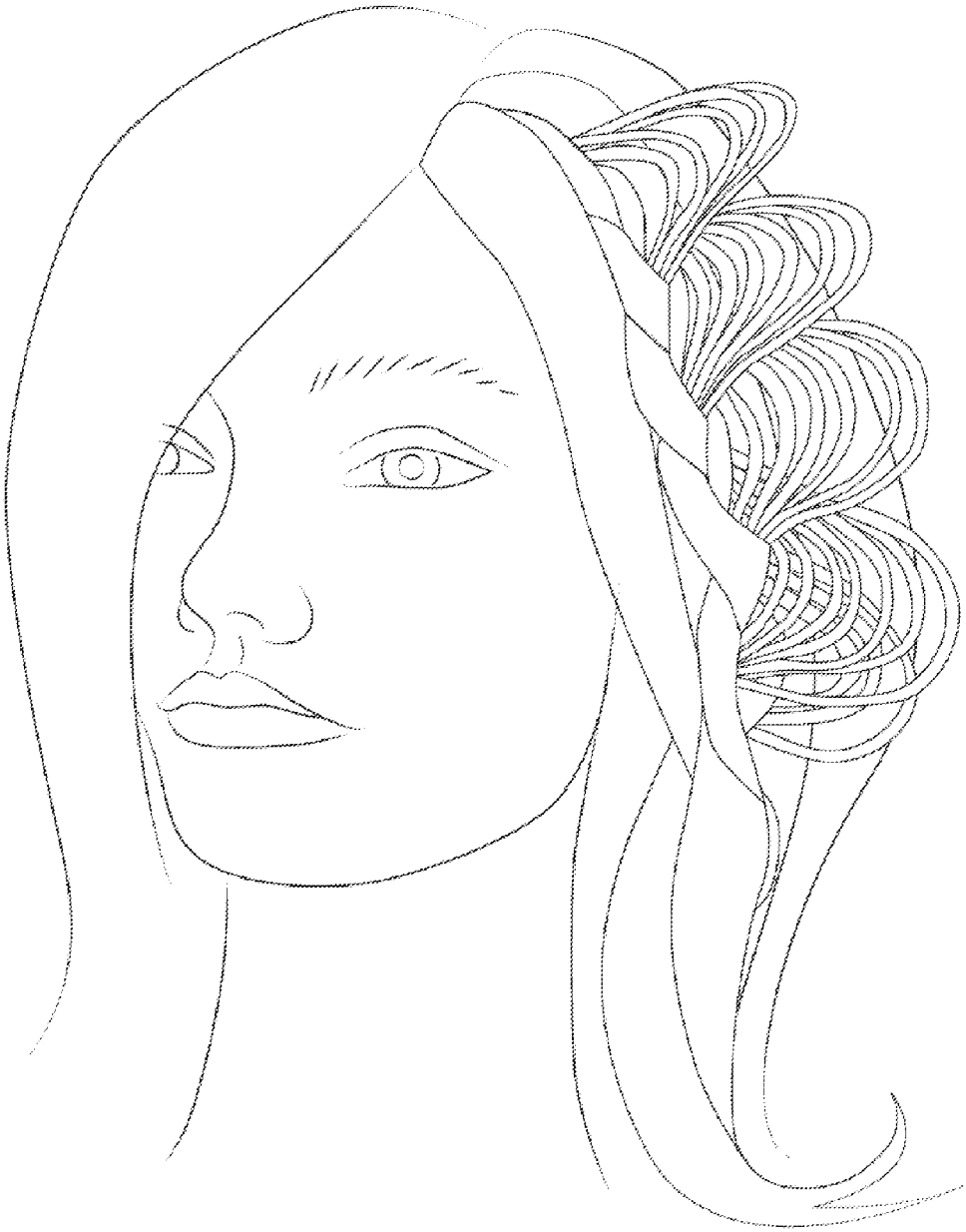
FIG. 3 shows an exemplary fanned-out braid section.

FIG. 3 shows an exemplary fanned-out braid section.

Figure 1:
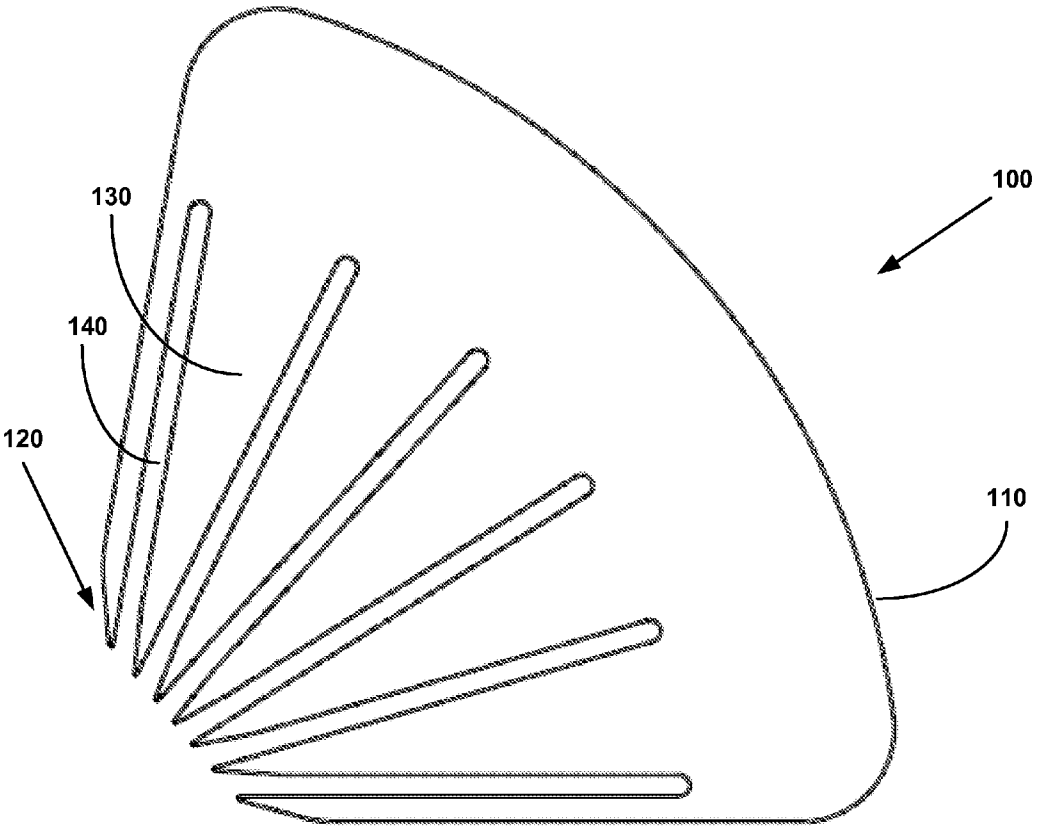
FIG. 1 depicts the hair styling device according to the present invention.

FIG. 1 is a schematic representation of the hair styling device 100 according to the present invention. Device 100 has a generally flat fan-like shaped body and comprises two opposite edges. The first longer edge 110 serves as a handle and the second shorter opposite edge 120 separated into a plurality of tooth-bases by slanting recesses 140, said recesses defining a plurality of evenly spaced substantially triangular teeth 130.

The structure described above of the hair styling device 100 is useful in separating the hair strand into sub-strands using the shorter edge 120 and, when the device is pushed further into the hair strand, enlarging the distance between the sub-strands to facilitate styling of hair styles such as shown, for example, in FIGS. 2 and 3.

Figure 4:
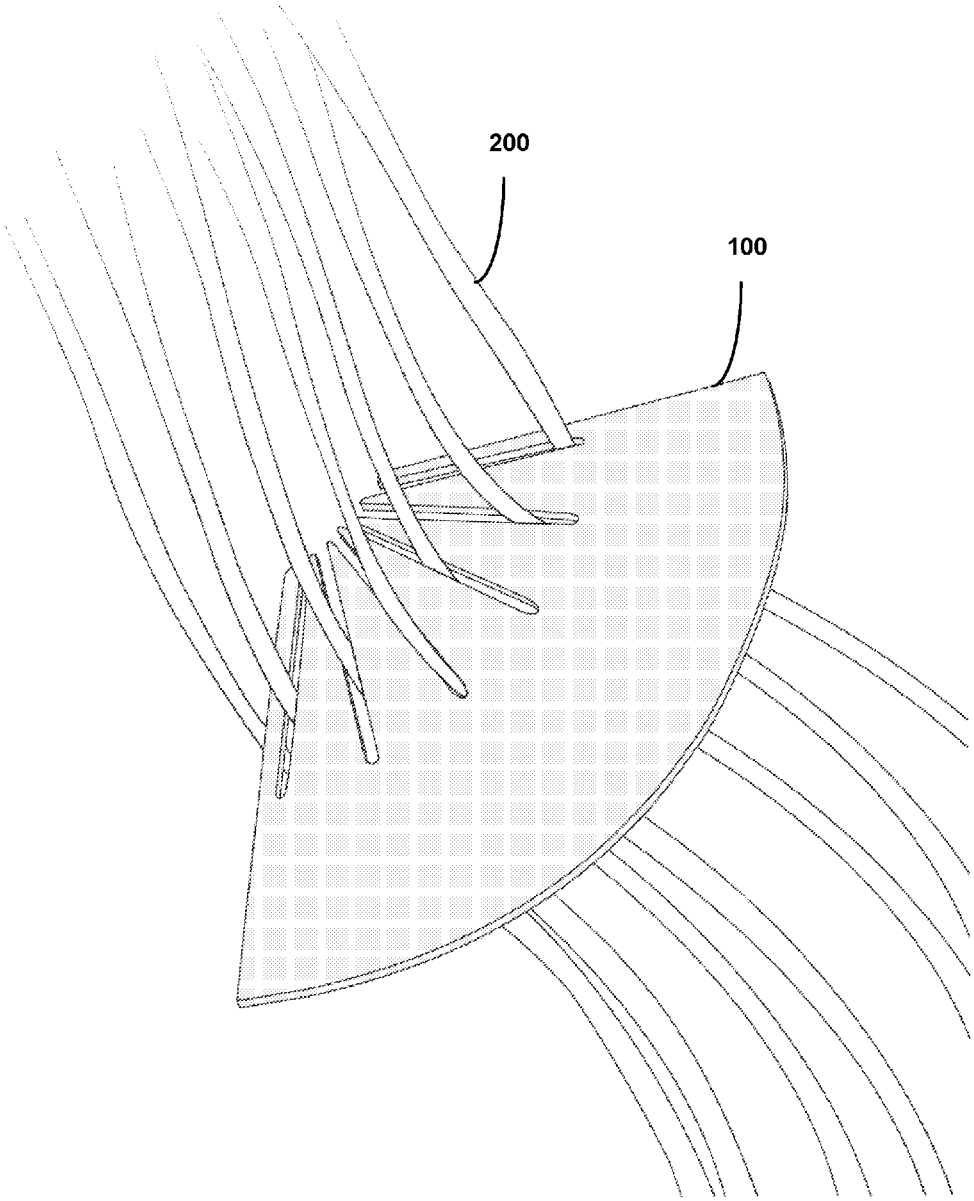
FIG. 4 shows the basic mode of operation of the styling device according to the present invention.

FIG. 4 shows the basic mode of operation of styling device 100 in creating sub hair strands 200, which may then be treated with any kind of firming product such as hair spray or gel, to preserve the fanned-out effect. Device 100 can then be further manipulated while still holding the sub-strands, for shaping the sub-strands into a desired shape, as sown for example in FIG. 2.

Hair styling device 100 may be made of metal, plastic, or any other suitable rigid material.

The invention claimed is:

1. A hair styling method comprising:

providing a hair styling device consisting of a rigid substantially flat body having two opposite edges, a first longer edge and a second shorter edge opposite the first edge, slanting recesses separating said shorter edge into a plurality of tooth-bases, said slanting recesses defining a plurality of evenly spaced substantially triangular teeth;

inserting the teeth into a hair strand, whereby the hair strand is divided into a plurality of even spaced-apart sub-strands held between the teeth;

pushing the device further into the hair strand, thereby enlarging the distance between the sub-strands;

firming the sub-strands; and manipulating the hair styling device to shape the firmed sub-strands into a desired shape.

* * * * *